US005482242A

United States Patent [19]

Jegelius

[11] Patent Number: 5,482,242

[45] Date of Patent: Jan. 9, 1996

[54] SUSPENSION DEVICE FOR LOW WEIGHT ARTICLES

[76] Inventor: Lennart Jegelius, Allhelgonagatan 11, S-118 58 Stockholm, Sweden

[21] Appl. No.: 341,421

[22] Filed: Nov. 17, 1994

[30] Foreign Application Priority Data

Apr. 11, 1994 [SE] Sweden ..... 9401194

[51] Int. Cl.[6] ..... A47H 1/10

[52] U.S. Cl. ..... 248/328; 248/329; 248/339; 248/301

[58] Field of Search ..... 248/328, 329, 248/339, 301, 303, 304, 548, 900, 909, 546; 24/129 A, 115 H, 115 M

[56] References Cited

U.S. PATENT DOCUMENTS

| | | | |
|---|---|---|---|
| 3,042,355 | 7/1962 | Stevens | 248/328 |
| 3,561,718 | 2/1971 | Iverson | 248/301 |
| 3,817,471 | 6/1974 | Finneman | 242/85.1 |
| 3,876,080 | 4/1975 | Hultberg et al. | 211/105.5 |

FOREIGN PATENT DOCUMENTS

| | | |
|---|---|---|
| 2518868 | 1/1983 | France . |
| 339295 | 12/1969 | Sweden . |
| 385184 | 6/1976 | Sweden . |

*Primary Examiner*—Leslie A. Braun
*Assistant Examiner*—Gwendolyn Wrenn
*Attorney, Agent, or Firm*—Ostrolenk, Faber, Gerb & Soffen

[57] ABSTRACT

A suspension device for the suspension of an article (10) of low weight at a variable distance below an attachment point for said device on a suitable support comprises a body (1) provided with attachment means (4), a flexible string (6) and an article holder (2). In order to avoid various drawbacks of such devices belonging to the prior art, the article holder (2) is formed integral with but easily separable from the body (1).

11 Claims, 2 Drawing Sheets

SUSPENSION DEVICE FOR LOW WEIGHT ARTICLES

BACKGROUND OF THE INVENTION

The present invention relates to a suspension device for the suspension of an article of low weight at a variable distance below an attachment point for said device on a suitable support.

More particularly, the invention relates to such a device of the kind comprising a body, provided with attachment means for attaching said body to said support at said attachment point, a flexible string of substantial length connected to said body at its one end, and an article holder, to which said body is connected at its other end, said body being also provided with a formation which is adapted to carry at least a major portion of the string wound thereon but from which a selectable length of said string portion may be unwound while leaving the remaining length thereof wound on said formation.

Suspension devices of said kind are used for many different purposes. Especially, they have found extensive use for the suspension of various signs, decorations and other articles of low weight at a selectable height at desired locations within shops, stores, exhibition rooms and similar places.

In prior art suspension devices of the above kind, the body has been formed by a steel wire, bent into a suitable shape to form, on the one hand, a hook which may be used as an attachment means for attaching the body to an attachment point on a wall, a ceiling or another support, and on the other hand, a formation for carrying the string wound thereon. The article holder has been formed by a separate metal needle, adapted to anchor said other end of the string to an article to be suspended by means of the suspension device.

In practice, said known suspension devices have been found to suffer from substantial disadvantages. Firstly, the manufacturing costs are comparatively high due to the fact that said devices are made through a series of manual operations as they are not suited for production by automatic means. Secondly, said known devices are impracticle in use as a consequence of the fact that the string may easily be unwound from said formation in an unintentional manner.

The present invention has for its object to provide an improved suspension device of the kind initially specified which avoids the above drawbacks previously encountered in connection with such suspension devices.

Another object of the invention is to provide a suspension device of said kind which may be attached to a suitable support in an alternative manner, i.e. which does not necessarily have to be hooked to the support.

SUMMARY OF THE INVENTION

In its broadest aspect, the invention seeks to provide a suspension device of the above kind, which offers the advantage of being cheap to manufacture and easy and convenient to handle during the practical use thereof. In accordance with the invention, said advantage is gained primarily by forming the article holder integral with the body but easily separable therefrom.

In a preferred embodiment of the invention, the body and the article holder are formed by a single moulding of plastic material, preferably obtained through injection moulding. In this case, the formation serving to carry the string may easily be given any desired, preferably cleat-like shape adapted to ensure that the string may be safely kept on said formation and prevented from escaping therefrom in an undesired manner.

In order to facilitate an easy separation of the article holder from the body, a weakening may be provided at the transition between said two portions of the moulding. Said weakening may for instance consist of one or more transversally extending grooves provided at said transition and making it possible easily to snap off the article holder from the body.

The attachment means may comprise a hook-shaped portion of the body. However, as an alternative to or in addition to such a portion, the attachment means may comprise a portion of the body having a substantially plane outer surface which is provided with an adhesive coating and an outer easily removable anti-adhesive covering layer. A suspension device provided with attachment means of the latter kind offers the advantage that it may be attached to a support simply by being brought to adhere thereto by means of said adhesive coating.

The article holder may preferably form a generally pin-shaped member having the string connected to a central portion thereof and suitably having at least one pointed end. In this case, the string may be anchored to an article by inserting said member through a small opening in the article already existing or made by means of said member. However, the article holder may have many other alternative shapes.

In order to avoid any entanglement of the string and to reduce any tendency to an unintentional unwinding of the string from the formation on which it is carried, the string may preferably consist of a thread or yarn, for instance a spun silk yarn, having a low stiffness.

Finally, in order to facilitate a convenient connection of the string to the body and the article holder, the body and the article holder may each be provided with integral clamping means defining a narrow gap in which an end portion of the string may be received and held. In addition or alternatively, the string ends may be connected to the article holder and the body by glue joints or melt joints.

BRIEF DESCRIPTION OF THE DRAWINGS

Below, the invention will be further described, by way of example, with reference to the accompanying drawings, in which.

DETAILED DESCRIPTION OF ILLUSTRATED EMBODIMENTS

Figure 1:
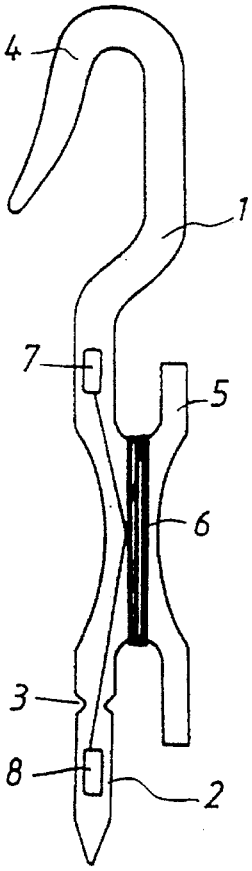
FIG. 1 is a side elevation of a suspension device according to a first embodiment of the invention.
Figure 2:
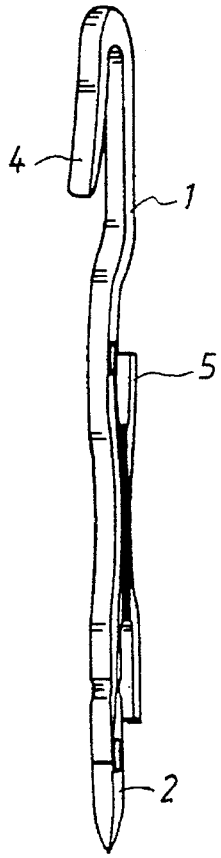
FIG. 2 is a perspective view of the device according to FIG. 1.

The suspension device shown in FIGS. 1 to 4 comprises a body 1 and an article holder 2 which are formed in one single piece and consist of a moulding of plastic material, for instance polystyrene, preferably obtained through injection moulding. Reference numeral 3 designates transversal grooves provided at the transition between body 1 and article holder 2 to form a weakening serving to facilitate an easy separation of article holder 2 form body 1.

At its upper end, body 1 is formed as a hook 4, serving as an attachment means by which the body may be attached to a suitable support. Moreover, at its one side it has a cleat-like formation 5 serving to carry a substantial length of a flexible string 6 wound thereon. The inner end of string 6 is connected to body 1 at 7, while the outer end of string 6 is connected to a central portion of article holder 2 at 8.

Preferably, at locations 7 and 8, respectively, body 1 and article holder 2 may be provided with integral clamping means defining a narrow gap in which the respective end portion of string 6 may be received and held. However, a glue joint or a melt joint may also be provided at each location 7 and 8 to secure string 6 firmly to body 1 and article holder 2, respectively.

String 6 should preferably have a low stiffness and may for instance consist of a spun thread or yarn.

Figure 3:
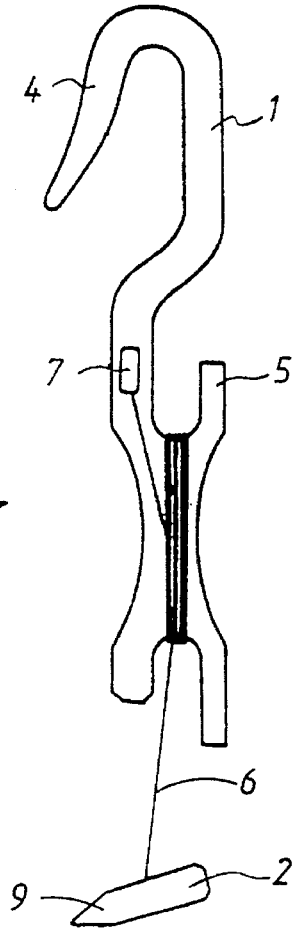
FIG. 3 is a side elevation of the suspension device according to FIG. 1, showing it in a state in which an article holder formed integral with the body of the device has been snapped off from the body.
Figure 4:
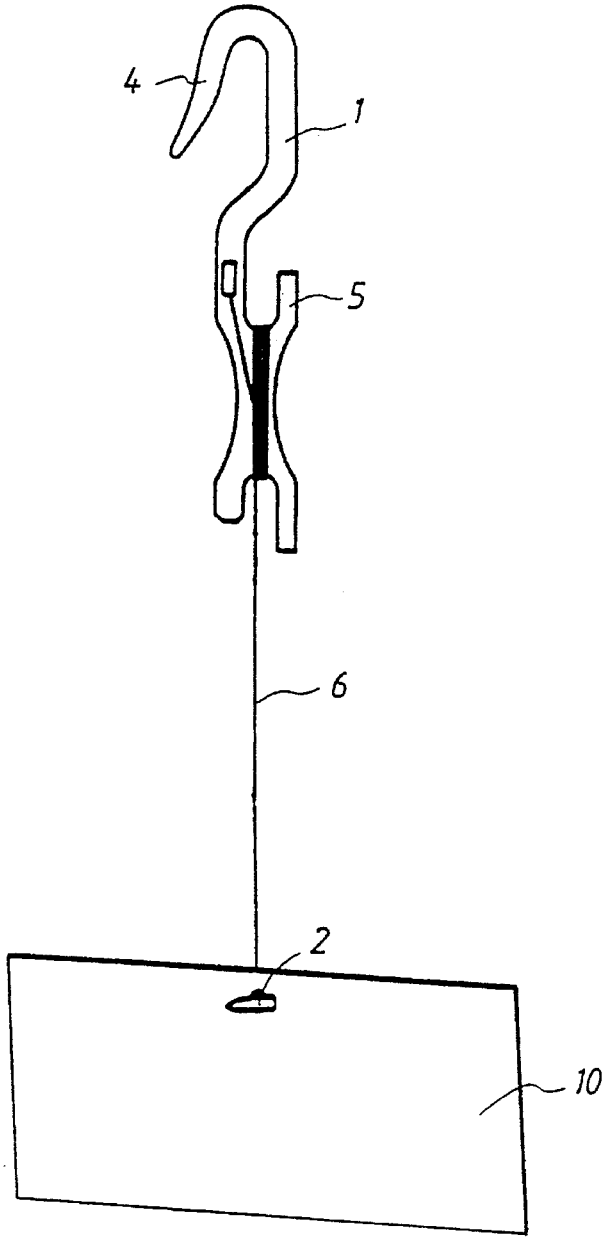
FIG. 4 shows the suspension device as used for the suspension of a sign.

When the suspension device is to be used, article holder 2, which is formed as a pin having a pointed end 9, is broken off from body 1 as shown in FIG. 3 and a suitable length of string 6 is unwound from cleat 5. Pin 2 may then be inserted in a hole in article 10, for instance a sign, intended to be suspended by means of the device. String 6 may hereby be anchored to said article in an easy and convenient manner. Hook 4 may then be hooked to any suitable support, whereby, as shown in FIG. 4, article 10 will become suspended at a height determined by the length of string 6 unwound from cleat 5.

Figure 5:
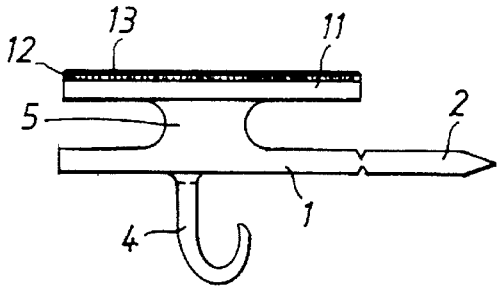
FIG. 5 is a side elevation of a suspension device according to a second embodiment of the invention.
Figure 6:
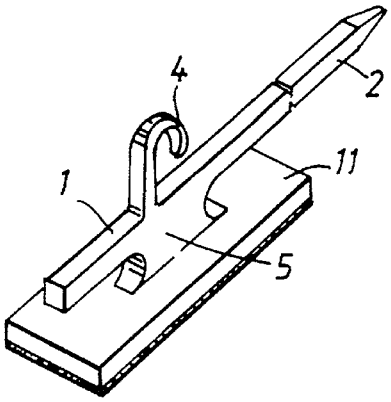
FIG. 6 is a perspective view of the device according to claim 5.

The embodiment shown in FIGS. 5 and 6 differs from the embodiment according to FIGS. 1 to 4 substantially only in respect of the attachment means by which body 1 may be attached to a support. According to FIG. 5 and 6 the attachment means comprises a hook 4, which projects laterally from body 1, and an opposite plate 11 which forms an outer portion of cleat 5. On its outer surface plate 11 is provided with an adhesive coating 12 and an outer easily removable anti-adhesive covering paper 13. Hereby body 1 may be attached to a support either by means of hook 4 or by means of plate 11 and the adhesive coating 12 provided on said plate.

The invention is not restricted to the embodiments above described and shown in the drawings. Instead, many other embodiments are feasible within the scope of the invention. For instance, if the device is provided with attachment means by which it may be brought to adhere to a support, it need not be provided with any hook-shaped attachment means.

I claim:

1. A suspension device for the suspension of an article of low weight at a variable distance below an attachment point for said device on a suitable support, said device comprising a body, provided with attachment means for attaching said body to said support at said attachment point, a flexible string of substantial length connected to said body at its one end, and an article holder, to which said string is connected at its other end, said body being also provided with a formation which is adapted to carry at least a major portion of the string wound thereon but from which a selectable length of said string portion may be unwound while leaving the remaining length thereof wound on said formation, characterized in that said article holder is formed in a one-piece integral manner with said body easily separable therefrom and that a weakening is provided to at a transition area between the body and the article holder.

2. A suspension device according to claim 1, characterized in that the body and the article holder are formed by a single moulding of plastic material, preferably obtained through injection moulding.

3. A suspension device according to claim 1, characterized in that said formation has a cleat-like shape.

4. A suspension device according to claim 1, characterized in that said weakening is formed by at least one transversally extending groove provided at said transition.

5. A suspension device according to claim 1, characterized in that said attachment means comprise a hooked-shaped portion of the body.

6. A suspension device according to claim 1, characterized in that said attachment means comprise a portion of the body having a substantially plane outer surface which is provided with an adhesive coating and an outer easily removable anti-adhesive covering layer.

7. A suspension device according to claim 1, characterized in that the article holder forms a generally pin-shaped member having the string connected to a central portion thereof and preferably having at least one pointed end.

8. A suspension device according to claim 1, characterized in that the string is formed by a thread or yarn, having a low stiffness.

9. A suspension device according to claim 1, characterized in that the body and the article holder are each provided with integral clamping means, defining a narrow gap in which an end portion of the string is received and held.

10. A suspension device according to claim 1, characterized in that the string ends are connected to the body and the article holder by glue joints or melt joints.

11. A suspension device according to claim 9, characterized in that the thread or yarn is a spun silk yarn.

* * * * *